US005451121A

United States Patent [19]

Seligman

[11] Patent Number: 5,451,121

[45] Date of Patent: Sep. 19, 1995

[54] COMBINATION BUOYANCY COMPENSATOR, SPIDER, AND BACKPACK WITH SECUREMENT AND SUSPENSION SYSTEM

[75] Inventor: Scott P. Seligman, Carlsbad, Calif.

[73] Assignee: Sea Quest, Inc., Carlsbad, Calif.

[21] Appl. No.: 162,666

[22] Filed: Dec. 2, 1993

[51] Int. Cl.[6] ..... B63C 11/02

[52] U.S. Cl. ..... 405/186; 441/106

[58] Field of Search ..... 405/185, 186; 441/88, 441/106, 108, 114, 115, 117

[56] References Cited

U.S. PATENT DOCUMENTS

| | | | |
|---|---|---|---|
| 4,016,616 | 4/1977 | Walters | 405/186 |
| 4,810,134 | 3/1989 | Faulconer et al. | 405/186 |
| 4,913,589 | 4/1990 | Faulconer et al. | 405/186 |
| 5,020,941 | 6/1991 | Bulin et al. | 405/186 |
| 5,046,894 | 9/1991 | Bergstrom | 405/186 |

*Primary Examiner*—David H. Corbin

*Attorney, Agent, or Firm*—George F. Bethel; Patience K. Bethel

[57] ABSTRACT

A combination unit of a buoyancy compensator, backpack, and spider having adjustable combination strap means forming a combination shoulder strap and belt strap means with releasable strap retaining means. A backpack for support of a gas cylinder is attached to the back of the spider. The buoyancy compensator overlies the spider and has two downward extending lobes, each having a bottom and sides that are configured to surround the backpack without interfering with the attachment of a pressurized gas cylinder. The buoyancy compensator includes independent suspension means whereby it is attached to the spider at the shoulder and neckline areas and tacked to the spider at the bottom of each downward lobe portion of the buoyancy compensator. Two buoyancy compensator strap means are attached to the spider and to the sides of each downward lobe of said buoyancy compensator and are restrained by an elastic tether attached to the spider to permit expansion of the buoyancy compensator away from a diver's body during inflation.

20 Claims, 7 Drawing Sheets

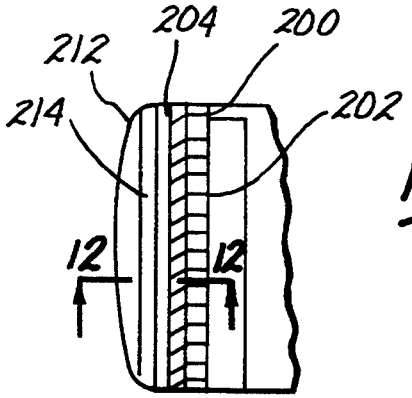
Fig. 9
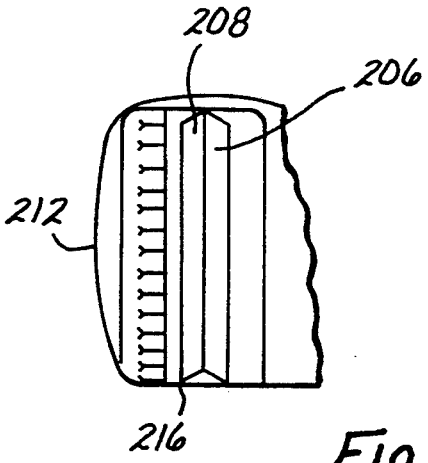
Fig. 10
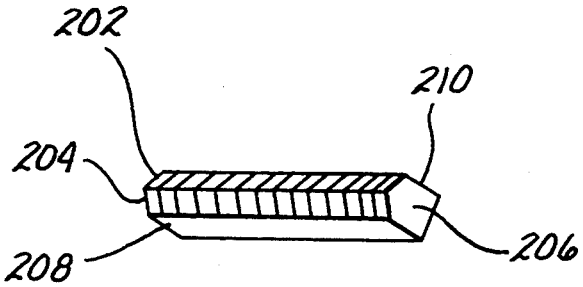
Fig. 11
Fig. 12
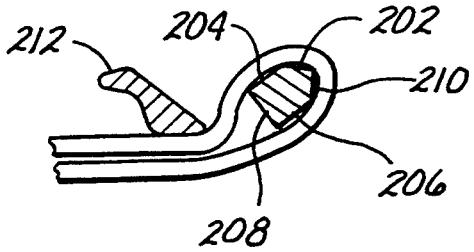

COMBINATION BUOYANCY COMPENSATOR, SPIDER, AND BACKPACK WITH SECUREMENT AND SUSPENSION SYSTEM

FIELD OF THE INVENTION

This invention relates to the field of buoyancy compensators and particularly to a combination buoyancy compensator, backpack and spider having a securement and suspension system that improves comfort and facilitates the use thereof.

DESCRIPTION OF THE PRIOR ART

Underwater diving preferentially requires the use of a buoyancy compensator having an inflatable bladder to provide for buoyancy trim or compensation to a diver.

Buoyancy compensators are inflated by oral power or compressed gas inflation means. During inflation, the diver is provided with increased buoyancy at greater depths to overcome the fact that a diver's buoyancy decreases as he dives deeper. This is because with greater pressure, a loss takes place regarding the lifting characteristics of the diver's buoyancy, primarily due to compression of his exposure suit and associated diving equipment.

Conversely, as the diver ascends or approaches the surface his buoyancy increases as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it.

In recent years, buoyancy compensators have been combined with a vest configuration commonly called a spider with means to hold a diver's backpack that supports a container or tank of pressurized gas on a diver's back. The vest configuration often includes shoulder straps and a front closing waist or belt fastener for ease in putting on and securing the buoyancy compensator.

During the process of inflation and deflation, the buoyancy compensator's inflatable bladder or inner chamber changes dimensions substantially compared with its uninflated state. When inflated, the buoyancy compensator changes from its original flat configuration and becomes more spherical in shape. This change in dimension causes tightening around the diver's waist since the bladder within the buoyancy compensator must expand against the diver's body and there is no opportunity for the interior dimensions to be adjusted.

Similarly, when the buoyancy compensator is deflated, pressure against the body is decreased. This causes a loosening of the pressure around the body and waist with the possible shifting of the load provided by the tank.

Changes in buoyancy also result in increases and decreases in the load exerted by the pressurized tank or cylinder held on the backpack. Some buoyancy compensators include adjustable shoulder straps attached to the waist or belt fastener. When the waist or belt is tightened, there is a corresponding tightening of the shoulder straps. Also, an increase in the load of the tank pulls the shoulder straps tightly causing the waist to tighten.

Thus, changes in buoyancy can result in substantial discomfort to the diver primarily due to tightening and pressure around the waist.

In addition, inflation of the buoyancy compensator affects the hydrodynamics of the buoyancy compensator. It is desirable to have the buoyancy compensator expand without causing a drag or flow restriction on a diver. This requires a body hugging or conforming profile.

It is an object of this invention to provide a combination buoyancy compensator having novel waist and chest or shoulder strap securement means.

It is a further object of the invention to provide an independent suspension means for the combination buoyancy compensator that minimizes the effects on the body and waist of a diver caused by the inflation and deflation of the bladder of the buoyancy compensator.

It is another object of the invention to provide a buoyancy compensator having a self-adjusting tether means for maintaining the condition of hugging or holding the buoyancy compensator against a diver's body during inflation and deflation without causing discomfort to the diver.

It yet a further object of the invention to provide an adjustable unified shoulder or chest strap and belt combination that tightens both the chest strap and belt strap by pulling on the belt strap ends and loosened by lifting the belt or chest strap fastener.

It is a final object of the invention to provide an adjustable chest strap and belt combination which is independent of the suspension means holding the buoyancy compensator.

SUMMARY OF THE INVENTION

The novel combination buoyancy compensator, vest and backpack of the invention provides an independent suspension system for the buoyancy compensator whereby the buoyancy compensator is maintained close to a diver's body during inflation and deflation.

The buoyancy compensator is suspended from the vest or spider by attachment at the shoulders and neckline areas and attached in two places, or plural locations at the bottom of the vest.

A pair of bands or strap means are secured to each of two anchor points on the back of the vest and to each of two side portions of each of two downward projecting portions of the buoyancy compensator. An elastic strap or tether attached to a waist portion of the vest or spider includes a ring through which is threaded one band or strap means. The ring can easily move along the strap means to lengthen the elastic strap with inflation and shorten or contract with deflation of the buoyancy compensator.

This permits the buoyancy compensator to conform closely to the diver's body and be relatively free to expand away from the diver's body to minimize discomfort to the diver. Improved hydrodynamics and comfort are thus provided.

Novel unified or combined chest and belt strap means extend downward from a pair of chest bands on the front of the vest to form a belt. The combined shoulder and belt strap means include a novel shoulder restraint or buckle. The free ends of the shoulder and belt strap means are threaded through an interlocking belt buckle or clamping means.

Tightening of the combined shoulder straps and belt is achieved by pulling on a ring attached to the end of the belt. Loosening is easily achieved by lifting the belt buckle and shoulder buckle and strap and pulling.

After tightening the desired amount, the novel chest strap restraint or buckle prevents tightening when the shoulder strap means are under a load. This prevents unwanted tightening of the shoulder and belt when the load is increased.

In use, after the overlapping waist extensions of the vest or spider have been secured, the belt buckle means is secured overall in the manner of a belt. Preferably, the overlapping waist extensions of the vest or spider are secured with interlocking areas of hooks and brushed material.

The elongated backpack or pressurized tank holder in the form of a molded hard plastic is secured to the back of the vest or spider at the top and bottom of the backpack leaving the intermediate area free. This area is utilized to loosely restrain or hold a tape or tie attached to each downward extending portion or lobe of the buoyancy compensator.

The entire combination or unit serves to improve the convenience and comfort of a diver by supporting the backpack and buoyancy compensator on a vest or spider so that the buoyancy compensator is maintained close to the body of a diver for improved hydrodynamics by holding the buoyancy compensator substantially independent of the other elements. At the same time, the buoyancy compensator is securely attached to the diver.

Adjustment of the shoulder and belt is easily accomplished with one hand and unwanted tightening at the waist is no longer a problem. This combination improves the capability of a diver to function as well as increasing comfort.

BRIEF DESCRIPTION OF THE DRAWINGS

The invention will be more clearly understood by referring to the description below and the accompanying drawings in which:

FIG. 9 shows a partially broken away perspective top view of a preferred fastener secured to the combined chest and belt strap means.

FIG. 10 shows a partially broken away perspective bottom view showing the reverse side of the fastener of FIG. 9.

FIG. 11 shows a perspective view of the cross bar of the fastener of FIGS. 9 and 10.

FIG. 12 shows a cross section taken along the lines 12—12 of FIG. 9.

DETAILED DESCRIPTION OF THE DRAWINGS

Figure 1:
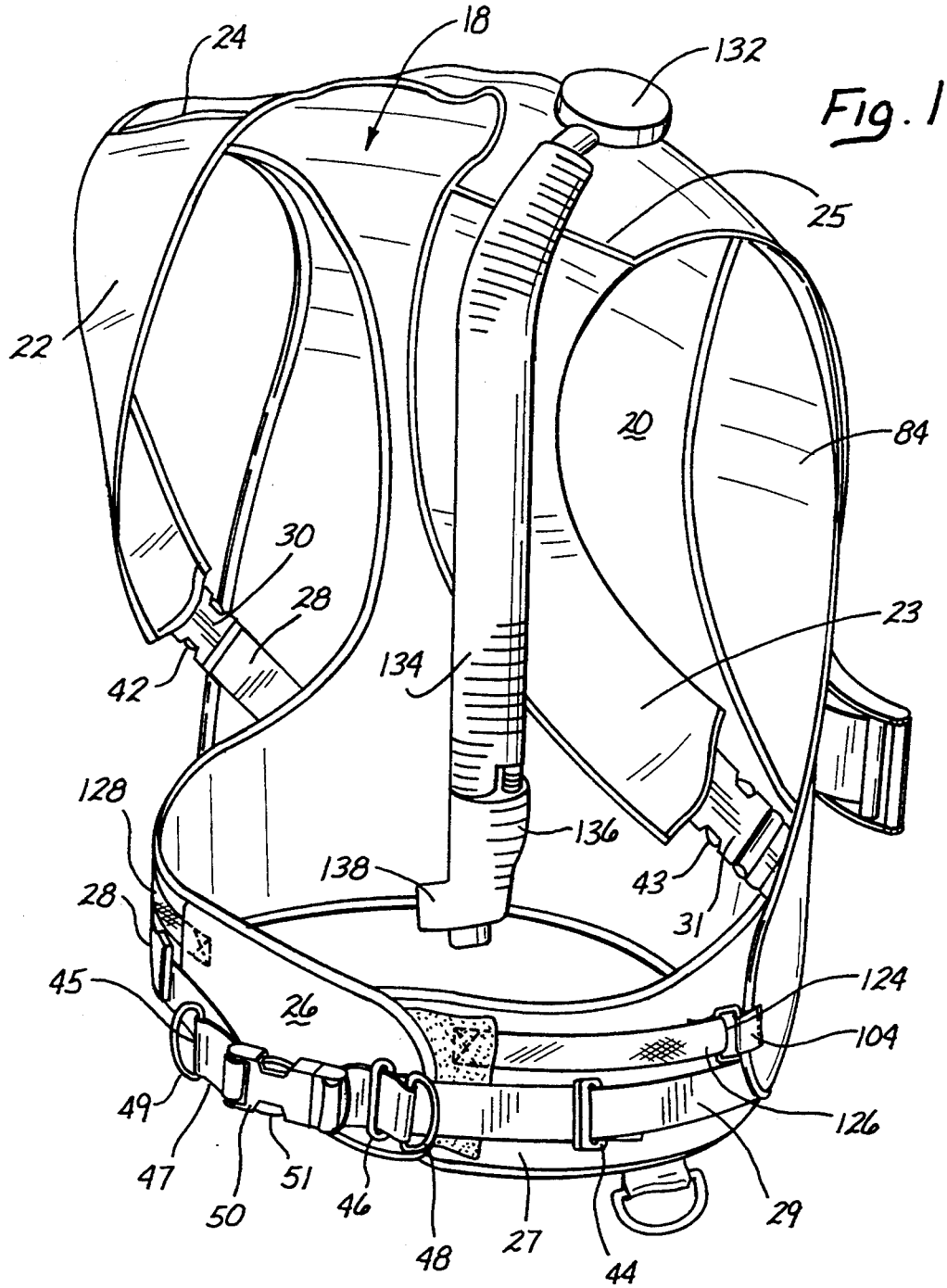
FIG. 1 shows a front perspective view of the combination buoyancy compensator, spider and backpack of the invention.

FIG. 1 shows a perspective front view of the combination spider, backpack and buoyancy compensator of the invention. The combination unit includes a spider or vest 18 including a back portion 20. The lower area of the back portion 20 extends forward into waist portions 26 and 27 that have interlocking hooks and brushed fabric areas for front overlapping securement.

Figure 2:
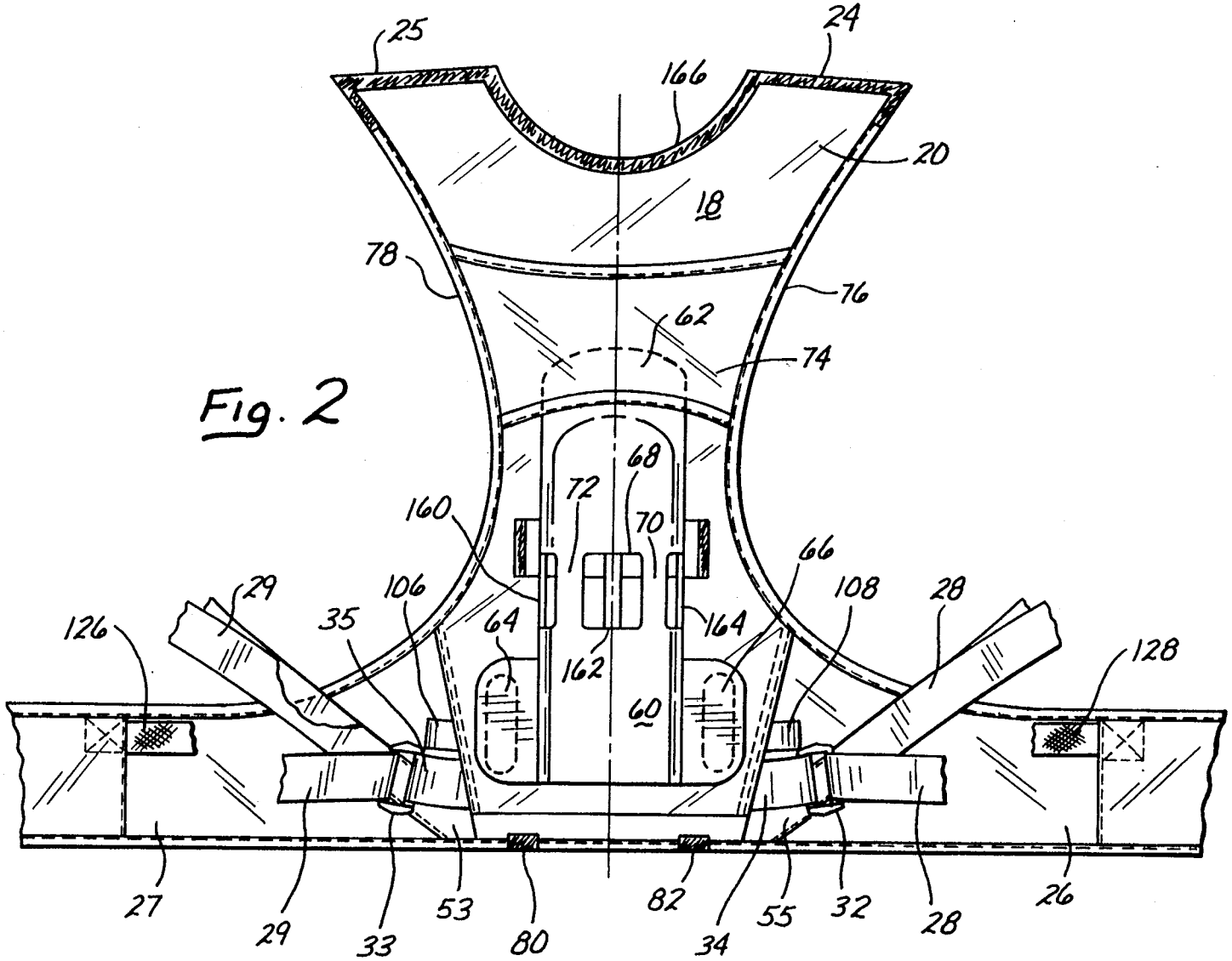
FIG. 2 shows a rear view of the vest or spider and the attached backpack with the buoyancy compensator removed.

The front and inside of the spider or vest 18 can be seen in FIG. 1. The exterior of the vest back 20 is shown in FIG. 2. As shown in FIG. 2, a backpack 60 for a pressurized gas cylinder, not shown, is secured to the spider 18. Preferably, the backpack 60 is stitched to the spider 18 at the top 62 and at the sides 64 and 66 where the outline of the stitching is shown near the bottom of the backpack. This leaves the space between the spider 18 and the backpack 60 free.

The backpack 60 as shown is formed of a hard plastic having a raised surface that is molded to the curved contour of a pressurized gas cylinder. A generally central aperture 68 separates exterior ribs 70 and 72. Interior ribs 160, 162 and 164 and exterior ribs 70 and 72 permit insertion of a band or strap, not shown, for securement of a pressurized gas cylinder on the backpack 60.

If desired, a flap of material 74 can cover the top of the backpack 60. The flap 74 is stitched to the edges 76 and 78 of the spider 18.

Figure 3:
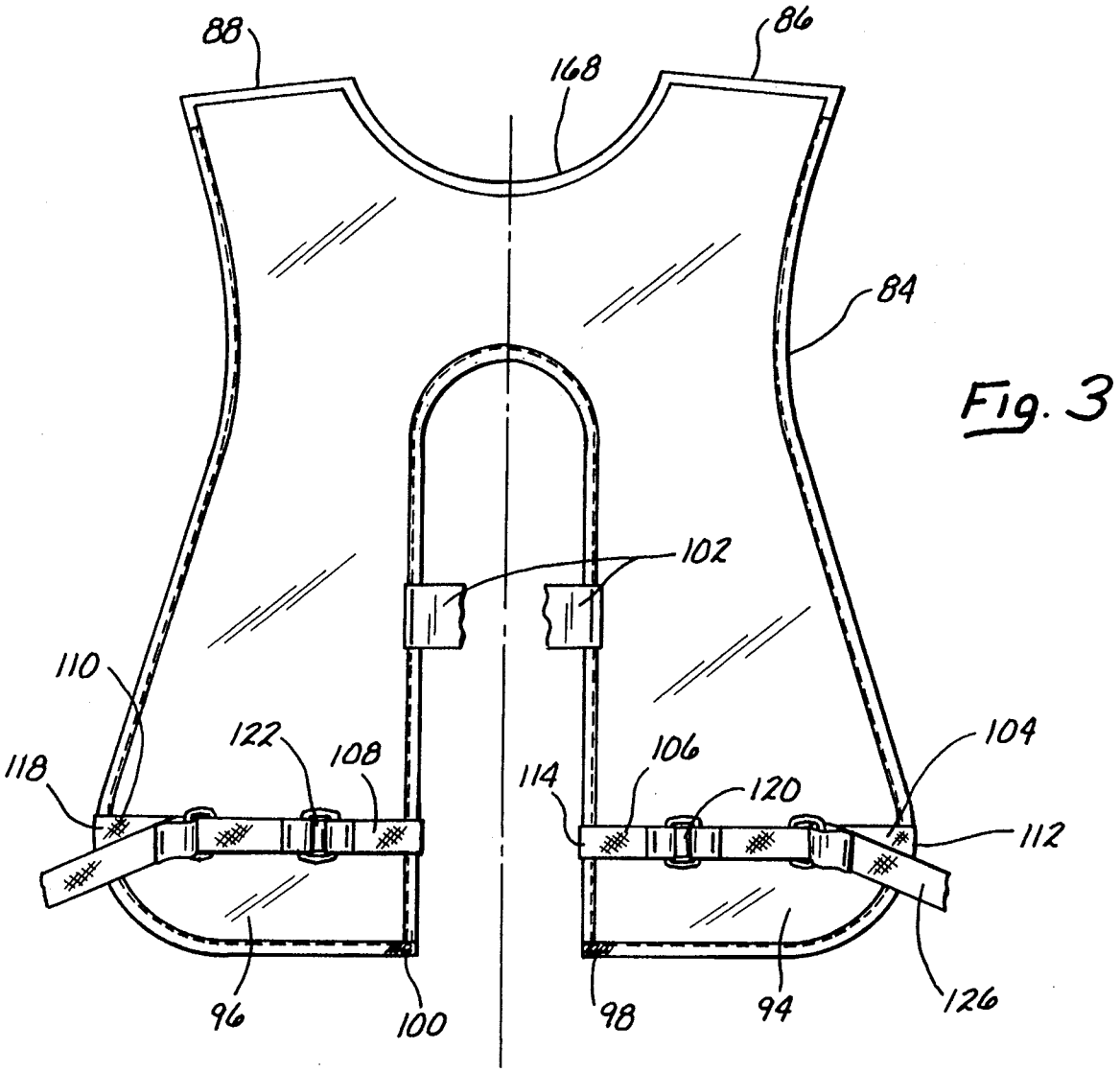
FIG. 3 shows an elevation front view of the buoyancy compensator as shown separately.

At the bottom of the spider 18 below the backpack 60 are two spaced apart areas of stitching 80 and 82 where the lower portion of a buoyancy compensator shown in FIG. 3 is secured. The buoyancy compensator is also secured to the shoulders 24 and 25 and neckline seam 166 of the spider 18 as hereinafter described.

Figure 4:
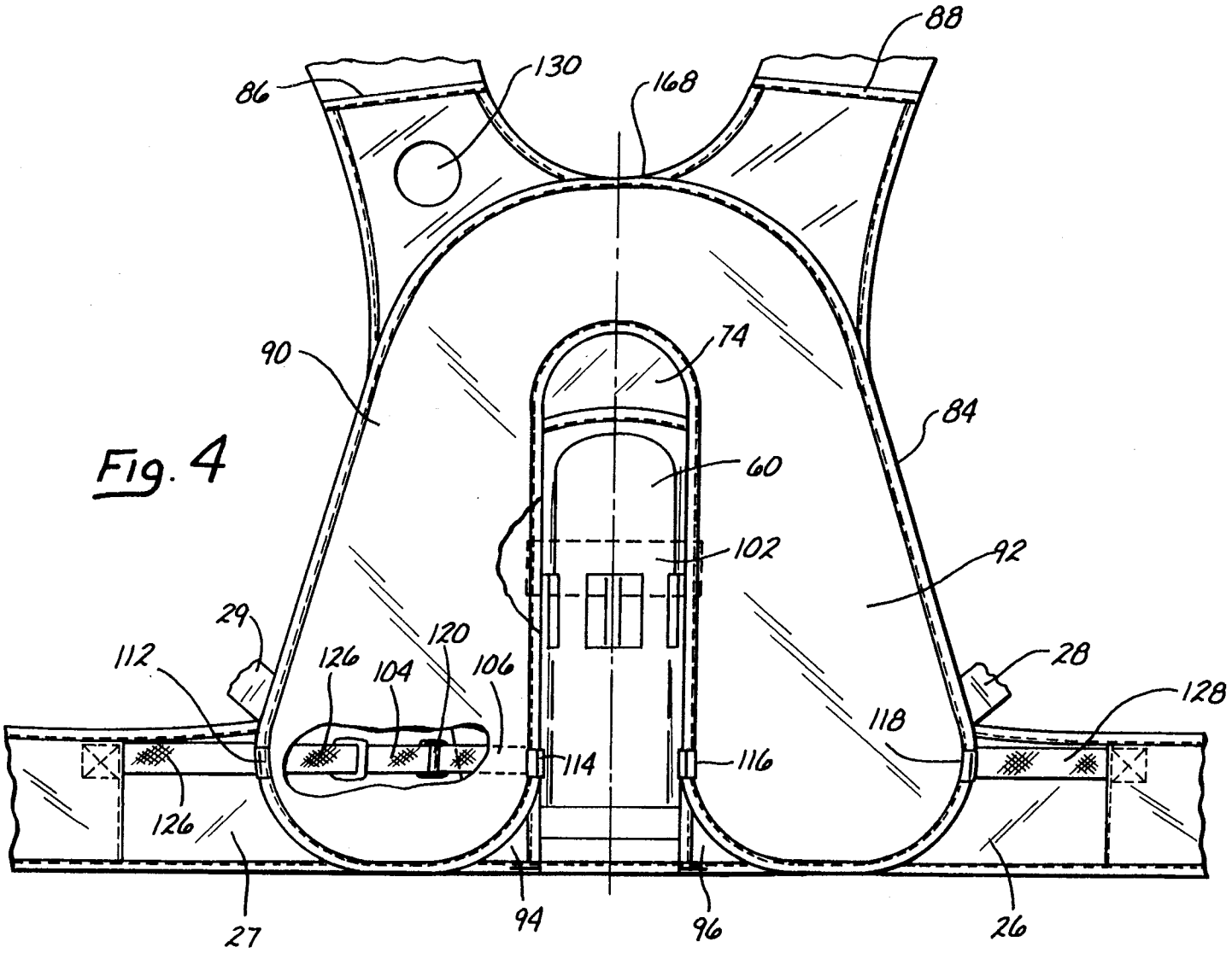
FIG. 4 shows a partially broken away elevation rear view of the combination buoyancy compensator, spider, and backpack of the invention showing the elastic tether and strap means for partial suspension of the buoyancy compensator.

As shown in FIG. 4, the buoyancy compensator overlies the back of the spider 18 and substantially surrounds the backpack 60. As can also be seen in FIG. 3, the buoyancy compensator indicated at 84 has shoulder portions 86 and 88 and neckline 168 which are matched with and secured as by stitching to shoulder portions 25 and 24 and neckline 166 of spider 18.

An opening 130 in the buoyancy compensator 84 enables emplacement of an over pressure release valve member and filling port 132. The release valve and filling port 132 include a valve which can be released by means of pulling the inflator tube 134. This in turn removes a poppet valve in the member 132 so that pressure in the buoyancy compensator can be released. Also, when pressure from the oral inflator mouthpiece is encountered or from a high pressure inflator, it is delivered through the tube 134 to the member 132, overcoming the poppet pressure and filling the buoyancy compensator.

FIG. 1 shows an inflator tube 134 attached to the release valve member and filling port 132 which terminates in an end connector 136. End connector 136 has a mouthpiece 138 and a means, not shown, in the form of a valve button which is in communication with a valve for inflation by means of an interconnecting tube with a high pressure line from a tank or cylinder not shown.

Such an air filling and release arrangement as above described is known to those skilled in the art. The invention is intended to include a combination buoyancy compensator, spider, and backpack as described herein and a novel securement and suspension system.

The buoyancy compensator 84 has two downward projecting portions or lobes 90 and 92. The exterior portion of lobes 90 and 92 are rounded at the bottom as shown in FIG. 4. The interior portion of the buoyancy compensator 84 as shown in FIG. 3 has generally the same configuration with the exception that the lobes have a squared off corner at the bottom adjacent the backpack as shown at bottom portions 94 and 96.

Bottom portions 94 and 96 are secured to the spider 18 by matching stitched areas 80 and 82 of the spider 18 shown in FIG. 2 with stitched areas 98 and 100 of bottom portions 94 and 96 of buoyancy compensator 84 shown in FIG. 3. In addition, the ends of a strap or tape 102 are passed between the spider back 20 and the backpack 60 and are secured between lobes 90 and 92 to maintain the buoyancy compensator 84 against the spider back 20.

Figure 8:
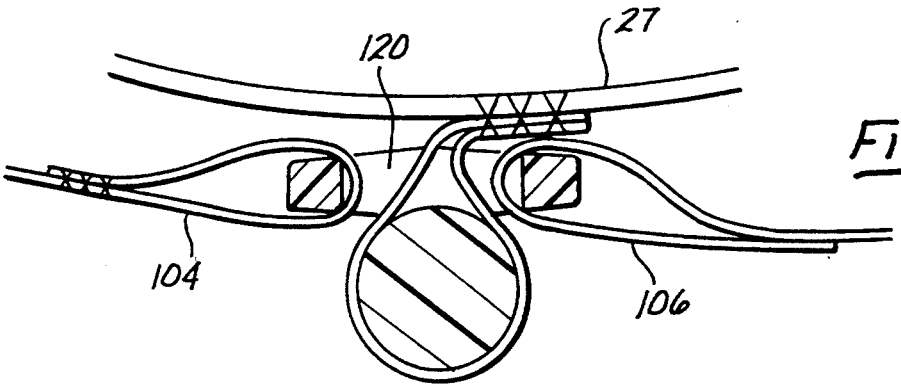
FIG. 8 shows an enlarged section detailing the anchor used to secure the band or strap means attached to the buoyancy compensator.
Figure 5:
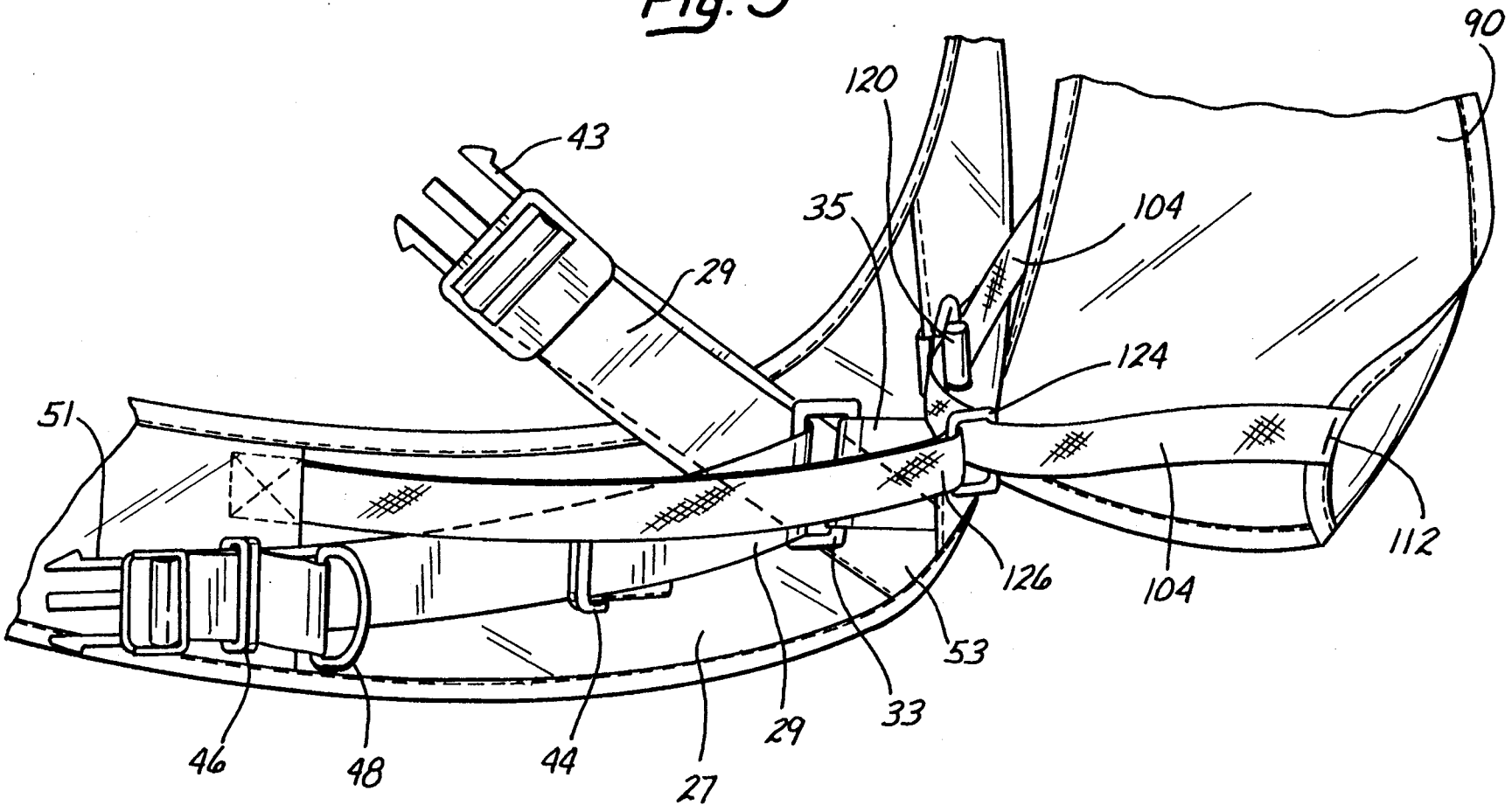
FIG. 5 shows an enlarged perspective side view of the combined chest and belt strap means and the tether arrangement of the buoyancy compensator band or strap means.

The buoyancy compensator 84, as best seen in FIGS. 3, 4 and 5, is further loosely confined or tethered to the spider 18 by means of buoyancy compensator bands or straps 104, 106, 108, and 110. One end of the bands or straps 104, 106, 108, and 110 are stitched respectively to the buoyancy compensator 84 at 112, 114, 116, and 118. The other ends of the bands or straps 104, 106, 108, and 110 are looped around or otherwise secured to a plastic anchor piece 120 or 122. Anchor piece 120 or 122 is secured to the exterior waist portions 27 or 28 as shown in FIGS. 4, 5, and 8.

Taken together, buoyancy compensator straps 104 and 106 pass around the rear side of lobe 90 of the buoyancy compensator in contact with the spider 18. In the same manner, straps 108 and 110 pass around the rear lobe 92 of the buoyancy compensator 84.

Strap 104 attached to lobe 90 and strap 110 attached to lobe 92 are threaded through a ring 124 and 122 respectively.

Ring 124 is attached to one end of an elastic strap 126. The opposite end of elastic strap 126 is also secured to waist portion 27 of spider 18. Similarly, ring 122 is attached to one end of an elastic length or strap 128. The opposite end of elastic strap 128 is secured to the waist portion 26 of spider 18.

Depending upon the inflation of the buoyancy compensator, ring 124 and ring 122 freely move back and forth along buoyancy compensator straps 104 and 110. This is possible because of the elastic nature of attached buoyancy compensator straps or tethers 126 and 128 that can expand and contract with the inflation and deflation of the buoyancy compensator.

Figure 7:
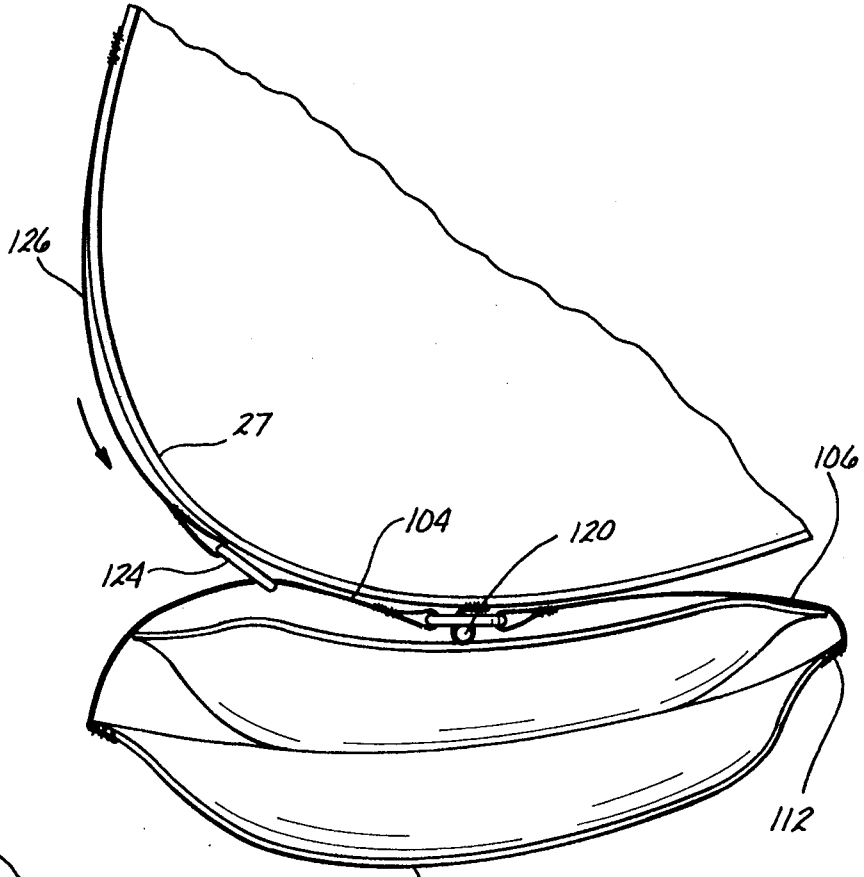
FIG. 7 shows an enlarged detail of the tether arrangement of FIG. 5 when the buoyancy compensator is inflated.
Figure 6:
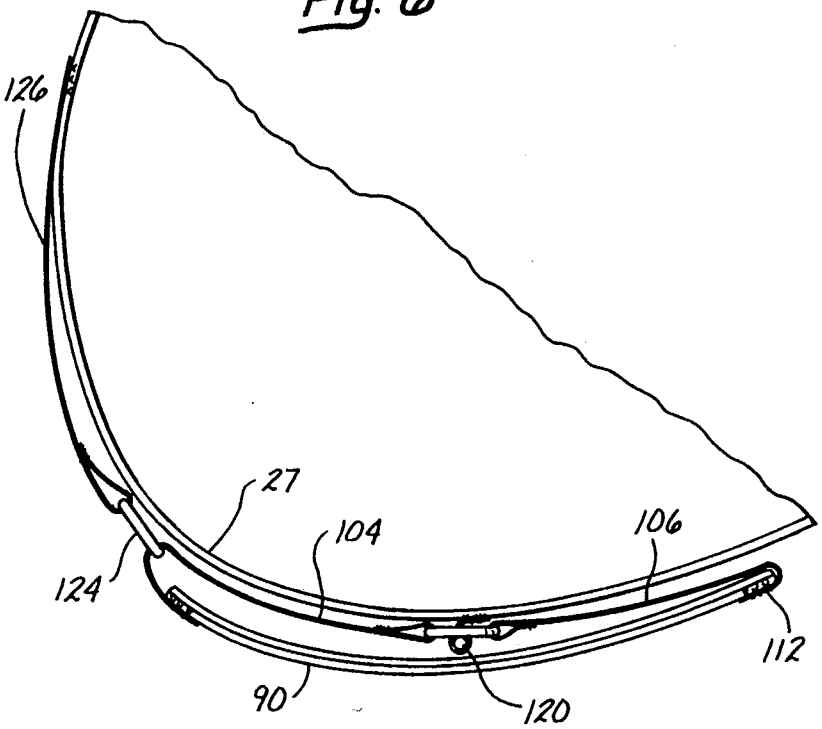
FIG. 6 shows an enlarged detail of the tether arrangement used to suspend the buoyancy compensator from the spider when the buoyancy compensator is deflated.

This suspension arrangement can best be seen in FIGS. 5, 6, and 7. FIG. 6 shows the buoyancy compensator 84 in the deflated condition and FIG. 7 shows the buoyancy compensator 84 in the inflated condition.

As shown in FIG. 7, during inflation of the buoyancy compensator 84, the buoyancy compensator is held or confined against a diver's body in an independent manner so that the waist portion 27 and the back portion 20 of the spider 18 are not compressed causing discomfort to a diver. At the same time, the buoyancy compensator 84 is safely secured to the vest and hugs the body of a diver to provide the required buoyancy and improve the hydrodynamics by minimizing drag.

Referring now to FIGS. 1, 2 and 5, it can be seen that the upper area of the back portion 20 of spider 18 includes shoulders 24 and 25 from which respective padded curved chest bands or straps 22 and 23 extend downward. The ends of the curved chest bands 22 and 23 are secured to one part 30 or 31 of a shoulder or chest fastener or buckle.

Matching interlocking shoulder or chest fastener or buckle parts 42 and 43 have adjustable straps 28 and 29 threaded therethrough. The chest fastener or buckle parts 42 and 43 are provided with a cross bar which has a roughened or toothed surface on one portion of its length and a smooth surface along another portion of its length. An extension of the buckle in the form of a curved member provides a means for grasping as well as a gripping or roughened surface as hereinafter described. A fastener or buckle representative of this type is detailed in FIGS. 9–12.

When the straps 28 and 29 are within buckle parts 42 and 43, the roughened surface of the cross bar prevents backward slipping of the straps 28 and 29 caused by tension from the chest bands. Tightening by pulling downwardly on the straps is easily achieved since the straps 28 and 29 slip over the smooth surface of the cross bar. If loosening is desired while the straps are under tension, this can easily be done by raising the curved member upward to release the straps from the roughened or toothed surface of the curved member and of the cross bar.

The buckle interlocking parts 30, 31, 42 and 43 and straps 28 and 29 form an extension from the curved chest bands 22 and 23.

As detailed in FIGS. 1 and 5, one end of each of the straps 28 and 29 is stitched down or otherwise fastened to the exterior side of waist portion 26 and 27 at 55 and 53. The free end of the strap 28 and 29 is threaded through chest or shoulder buckle interlocking part 42 and 43 respectively.

The straps 28 and 29 are threaded through chest buckle or fastener parts 42 and 43 as shown in FIGS. 1, 2 and 5 and then are threaded respectively through a preferably plastic loop 32 and 33. Loops 32 and 33 are secured respectively to a stationary strap 34 and 35 stitched or otherwise fastened at an angle to the exterior side of waist portion 26 and 27 respectively as shown in FIG. 2.

As detailed in FIGS. 2 and 5, passage of the straps 28 and 29 through loops 32 and 33 orients the straps 28 and 29 from a generally downward direction extending from the chest bands 22 and 23 to a generally horizontal direction for extension around a diver's waist in the manner of a belt.

Thus, after passage through loops 32 and 33, the straps 28 and 29 extend around the waist portions 26 and 27 of vest or spider 18 to form a belt.

The free ends of the straps 29 and 28 are threaded through a first retaining loop 44 and 45 respectively and then through one respective part of belt interlocking parts 51 and 50 which form a belt fastener or belt buckle.

The ends of the straps 29 and 28 are then passed respectively through a second retaining loop 46 and 47. Finally, the ends are then looped respectively around a pull ring 48 and 49 to which the ends are secured as by stitching.

Interlocking fastener or buckle parts 51 and 50, 42 and 30, and 43 and 31 are each provided with a strap restraining means. As shown in FIGS. 9–11, the fasteners have a cross bar 200 which has a roughened or toothed surface 202 and 204 on one portion of its length and a smooth surface 206, 208 and 210 along another portion of its length.

An extension of the buckle or fastener in the form of a curved member 212 provides a means for grasping. The curved member as shown in FIG. 9 has a smooth surface 214 on its top and a roughened or toothed surface 216 on its bottom side.

When the straps 28 and 29 are within buckle parts 51 and 50, the roughened surfaces 202 and 204 of the cross bar and roughened or toothed surface 216 of the curved member 212 prevent backward slipping of the straps 28 and 29 caused by tension from the chest bands.

Tightening of the straps 28 and 29 by pulling on the pull rings 48 or 49 is easily achieved since the straps 28 and 29 slip over the smooth surfaces 206, 208, and 210 of the cross bar 200 and over the smooth surface 214 of the curved member 212. If loosening is desired while the straps 28 and 29 are under tension, this can easily be done by raising the curved member upward to release the straps from the roughened or toothed surface of the cross bar.

The effect of the above described arrangement of the straps 28 and 29 is to enable tightening of the waist and shoulders of the spider by pulling on the pull rings 48 and 49. This in turn causes the straps 28 and 29 to be shortened and then held to the desired length by the roughened cross bar on interlocking chest or shoulder fastener parts 42 and 43.

Interlocking chest or shoulder fastener parts 42 and 43 permit the easy tightening and holding of the straps 28 and 29. Loosening of the straps is prevented when the belt is under tension. Loosening requires lifting the respective chest fastener parts 42 and 43 upward causing the straps to slip over the smooth surface of the cross bar to allow loosening of the straps 28 and 29.

One advantage is the convenient and quick tightening of the combined shoulder and belt straps 28 and 29 after donning the spider and securing the straps in the adjusted position by means of the buckle or fastener parts 50 and 51.

An additional advantage is the fact that an increased load or weight on the backpack does not cause the waist area to be tightened.

The buoyancy compensator 84 can be formed of any material such as a nylon or other flexible woven or unwoven material having a plastic inner sealant or coating. Normally the buoyancy compensator 84 is formed of two major front and back portions separated by gussets to permit expansion upon inflation.

The spider or vest 18 including the chest bands 22 and 23 is preferably made of a padded elastomeric foam material. Most preferred is a combination of knit material and foam cellular material that can expand and contract at various depths. Additional foam padding can be added as desired beneath the backpack 60 and over the shoulder 215 and 26 and chest bands 22 and 23.

The waist portions of the spider are preferably secured by overlapping of hooks and interlocking brushed areas. Other fastening means can be substituted such as hooks and eyelets, clamps and the like.

The strap means 28 and 29 and the buoyancy compensator suspension straps 104, 106, 108, and 110 are preferably formed of a strong, tough, woven material such as nylon although other materials can be substituted.

Due to the exposure of the combination unit to corrosive conditions of salt water and the like, it is preferred that the shoulder or chest fasteners 30, 42 and 31, 43 and the belt fastener 50, 51 and associated guides and rings be formed of a strong plastic material although stainless steel or chromed metals can be used.

The chest fasteners 30, 42, and 31, 42 and the belt fastener 50, 51 shown are of a combination sheath and insertable fork which expands after insertion into the sheath and is released by squeezing. Other types of fasteners are known which can be substituted including among others, those such as various buckles and clasps.

Any plastic material selected for the backpack or fasteners should be one which is not adversely affected by exposure to pressures encountered at various diving depths.

Similarly, while stitching is shown and described, it is most preferred to use adhesive and stitching for added strength.

Various modifications of the invention are contemplated and can be resorted to by those skilled in the art without departing from the spirit and scope of the invention as defined by the following claims.

I claim:

1. A suspension system for suspending a buoyancy compensator from a spider wherein:

said buoyancy compensator comprises a back portion having two shoulder portions and two downward extending lobe portions, each lobe portion having a bottom and side portions, said spider comprises two shoulder portions, a back portion, and two waistband portions which extend from the back portion for fastening around a diver's waist and two forward chest portions extending from the two shoulder portions, said suspension system comprising:

attachment means for attaching the shoulder portions of said buoyancy compensator to the shoulder portions of said spider;

securement means for securing at least a portion of the bottom of each downward lobe portion of said buoyancy compensator to a bottom portion of said spider; and, buoyancy compensator strap means secured to said spider and to the downward lobe portions of said buoyancy compensator.

2. A suspension system according to claim 1 comprising two or more buoyancy compensator strap means attached to said spider and to the sides of said downward lobe portions of said buoyancy compensator.

3. A suspension system according to claim 2 further comprising:

an anchor member secured to said spider and to said buoyancy compensator strap means.

4. A suspension system according to claim 3 further comprising:

a band extending between and attached to said downward lobe portions of said buoyancy compensator.

5. A suspension system according to claim 4 further comprising:

elastic strap means secured to the waistband portions of said spider and to said buoyancy compensator strap means.

6. A suspension system according to claim 5 further comprising:

loop means attached to the end of said elastic strap means for adjustably restraining and holding said buoyancy compensator against a diver's body.

7. A suspension system according to claim 6 further comprising:

a backpack for attachment of a cylinder of gas;

said buoyancy compensator downward extending lobe portions defining a space between them for said backpack;

securement means for securing said backpack to said back of said spider leaving a space between said backpack and said spider;

said band extending between said downward lobe portions of said buoyancy compensator is inserted within the space between said backpack and said spider to hold said buoyancy compensator against the back of said spider.

8. A suspension system for a buoyancy compensator as claimed in claim 7 further comprising:

said spider chest portions comprising chest bands;

second strap means forming combined chest straps and waist bands for said spider;

a first fastener attached to said chest bands and to said second strap means;

an angled loop secured to said spider for through passage of said second strap means;

a second fastener attached to said second strap means for joining said second strap means together over the waist portions at the front of said spider in the manner of a belt.

9. A suspension system as claimed in claim 8 further comprising:

a two part chest band fastener, one part being attached to the ends of said chest bands, the other part being attached to said second strap means.

10. A suspension system as claimed in claim 9 further comprising:

lock means associated with said chest band fastener which resists loosening upon pressure from a load exerted by the backpack.

11. A combination unit of a buoyancy compensator, backpack, and spider including a suspension system for said buoyancy compensator and combined chest and belt strap means for said spider comprising:

a spider comprising a back portion having lower portions extending into front waistband portions for securing around a diver's waist, shoulder portions having chest band portions extending downward for overlying a diver's chest and adjustable combination strap means extending from said chest band portions forming a combination shoulder strap and belt strap means;

a backpack for support of a gas cylinder attached to the back of said spider;

a buoyancy compensator having shoulder portions attached to the shoulder portions of said spider and two downward extending lobes, each having a bottom and sides that are configured to surround said backpack without interfering with the attachment of a pressurized cylinder;

suspension means for said buoyancy compensator comprising attachment means for attaching the shoulder portions of said buoyancy compensator to the shoulder portions of said spider;

securement means for securing at least a portion of the bottom of each downward lobe portion of said buoyancy compensator to a bottom portion of said spider; and, at least one buoyancy compensator strap means attached to said spider and to the sides of each of said downward lobe portions of said buoyancy compensator.

12. A combination unit as claimed in claim 9 further comprising elastomeric strap means secured to said buoyancy compensator strap means to act as a tether whereby said elastomeric strap means can lengthen and shorten in response to the inflation and deflation of said buoyancy compensator to maintain said buoyancy compensator against a diver's body.

13. A combination unit as claimed in claim 10 further comprising:

ring means attached to said elastomeric strap means and through which said buoyancy compensator strap means is threaded.

14. A combination unit according to claim 11 further comprising:

backpack securement means for securing the top and the bottom of said backpack to said spider leaving a space between said backpack and said spider;

band means extending in the space between said backpack and said spider, the ends of said band means being attached to the adjacent lobes of said buoyancy compensator to hold it against the spider.

15. A combination unit according to claim 12 further comprising:

one or more retaining means for said adjustable combination straps, said one or more retaining means being attached to said spider for retaining said straps and for changing the angle of said straps from a generally downward direction to a generally horizontal direction for attachment to a fastener for securing around the waist of a user in the manner of a belt.

16. In a combination unit having a spider, a backpack and an overlying buoyancy compensator, the improvement which comprises independent suspension means in the form of buoyancy compensator strap means attached between said buoyancy compensator and said spider; and, elastic tether means attached to said spider and to said buoyancy compensator strap means.

17. A combination unit according to claim 16 further comprising: combined chest strap means and waistband strap means attached to said spider.

18. A combination unit according to claim 17 further comprising:

at least one fastener for said combined chest strap means and waistband strap means having a crossbar with a roughened surface and a smooth surface and lifting means for holding said chest strap means against said roughened surface when said lifting means is against said strap means and for holding said chest strap means against said smooth surface when said lifting means is raised.

19. A combination unit according to claim 18 wherein said combined chest and waistband strap means includes a loop disposed at an angle for reception of said combined chest and waistband strap means and for changing the downward orientation of said chest and waistband strap means to a horizontal direction for use as a belt.

20. A combination unit according to claim 19 further comprising:

at least one fastener for each said combined chest strap means attached to said spider;

at least one fastener attached to the free end of said combined chest strap means forming said waistband strap means;

each fastener having at least one crossbar with a roughened surface and a smooth surface and lifting means having a smooth surface and a roughened surface for holding said chest strap means and said waistband strap means against said roughened surfaces when said lifting means is against said chest strap means or against said waistband strap means and for holding said chest strap means or said waistband strap means against said smooth surfaces when said lifting means is raised.

* * * * *